US006813464B2

(12) United States Patent
Amita et al.

(10) Patent No.: US 6,813,464 B2
(45) Date of Patent: Nov. 2, 2004

(54) FIXING DEVICE WITH A PEELER AND BIASING DEVICES AND IMAGE FORMING APPARATUS INCLUDING THE SAME

(75) Inventors: Akiyasu Amita, Kanagawa (JP); Kenji Ishii, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/375,031

(22) Filed: Feb. 28, 2003

(65) Prior Publication Data

US 2003/0165348 A1 Sep. 4, 2003

(30) Foreign Application Priority Data

Mar. 1, 2002 (JP) ..... 2002-056640
Mar. 4, 2002 (JP) ..... 2002-056693

(51) Int. Cl.[7] ..... G03G 15/20
(52) U.S. Cl. ..... 399/323; 271/307
(58) Field of Search ..... 399/322, 323, 399/398, 399; 271/307, 308, 311

(56) References Cited

U.S. PATENT DOCUMENTS 4,065,120 A * 12/1977 Imaizumi et al. ..... 271/311
5,541,712 A 7/1996 Fujitaka et al.
6,490,428 B1 * 12/2002 Fromm et al. ..... 399/323
6,658,229 B2 * 12/2003 Ando et al. ..... 399/323
6,678,496 B1 * 1/2004 Aslam et al. ..... 399/323
2002/0025204 A1 2/2002 Ando et al.

FOREIGN PATENT DOCUMENTS

| | | |
|---|---|---|
| JP | 8-29873 | 3/1996 |
| JP | 10-74015 | 3/1998 |
| JP | 2000-219383 | 8/2000 |
| JP | 2001-222182 | 8/2001 |
| JP | 2001-240284 | 9/2001 |
| JP | 2002-14565 | 1/2002 |
| JP | 2002-145503 | 5/2002 |

* cited by examiner

*Primary Examiner*—William J. Royer
(74) *Attorney, Agent, or Firm*—Oblon, Spivak, McClelland, Maier & Neustadt, P.C.

(57) ABSTRACT

A fixing device of the present invention includes a rotary body and a peeler rotatable about a support shaft and including an edge portion capable of contacting the surface of the rotary body. The edge portion includes a guide surface opposite to a surface that faces the rotary body. A first biasing device exerts on the peeler a force that tends to cause the edge portion to contact the rotary body about the support shaft. A guide guides the support shaft between a contact position where the edge portion contacts the rotary body and a non-contact position where the former is released from the latter. A second biasing device biases the support shaft toward the contact position. A guide member includes a guide surface that becomes substantially flush with the guide surface of the edge portion when the peeler is moved from the contact position toward the non-contact position against the action of the second biasing device.

25 Claims, 5 Drawing Sheets

FIXING DEVICE WITH A PEELER AND BIASING DEVICES AND IMAGE FORMING APPARATUS INCLUDING THE SAME

BACKGROUND OF THE INVENTION

1. Field of the Invention

The present invention relates to a fixing device including a peeler and an image forming apparatus including the fixing device.

2. Description of the Background Art

An image forming apparatus for forming a toner image with toner includes a fixing device configured to fix the toner image on a sheet or similar recording medium. The fixing device includes a heat roller accommodating heating means therein and a press roller pressed against the heat roller. The heat roller and press roller fix a toner image carried on a sheet with heat and pressure while nipping the sheet therebetween. To reduce toner offset, the surface of the heat roller is coated with Teflon (trade name) or covered with a Teflon tube that enhances parting ability. Further, a peeler is held in contact with the heat roller for preventing the sheet from wrapping around the heat roller due to, e.g., toner adhered to the heat roller. The peeler is positioned slightly above the nip between the heat roller and the press roller. In this condition, the underside of the peeler serves to guide the sheet between the heat roller and an outlet roller pair.

The fixing device described above has the following problem left unsolved. When the sheet jams a path preceding the outlet roller pair, it deforms in the form of bellows and contacts the edge portion of the peeler. As a result, the sheet presses the peeler in the direction in which the peeler bites into the heat roller. This causes the peeler to peel off the Teflon layer of the heat roller or otherwise damage it and makes it necessary to replace the heat roller.

To solve the above problem, Japanese Patent is Laid-Open Publication No. 2001-240284, for example, proposes a fixing device including a peeler configured such that when a jamming sheet presses the edge of the peeler, a support shaft supporting the peeler moves in the direction in which the peeler does not bite into a heat roller. Even such a fixing device has a drawback that when the sheet presses the peeler more than expected, the peeler scratches the heat roller with its edge. Particularly, as for a heat roller covered with an elastic layer for enhancing image quality, the peeler bites into the elastic layer more than into the Teflon layer even if the pressing force is weak.

Technologies relating to the present invention are also disclosed in, e.g., Japanese Patent Publication No. 8-29873 (Japanese Patent Laid-Open Publication No. 61-86343) and Japanese Patent Laid-Open Publication Nos. 10-74015, 2002-14565 and 2002-145503.

SUMMARY OF THE INVENTION

It is an object of the present invention to provide a fixing device capable of protecting a rotary body from damage even when a peeler is pressed against the rotary body more than expected, and an image forming apparatus using the same.

A fixing device of the present invention includes a rotary body and a peeler rotatable about a support shaft and including an edge portion capable of contacting the surface of the rotary body. The edge portion includes a guide surface opposite to a surface that faces the rotary body. A first biasing device exerts on the peeler a force that tends to cause the edge portion to contact the rotary body about the support shaft. A guide guides the support shaft between a contact position where the edge portion contacts the rotary body and a non-contact position where the former is released from the latter. A second biasing device biases the support shaft toward the contact position. A guide member includes a guide surface that becomes substantially flush with the guide surface of the edge portion when the peeler is moved from the contact position toward the non-contact position against the action of the second biasing means.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
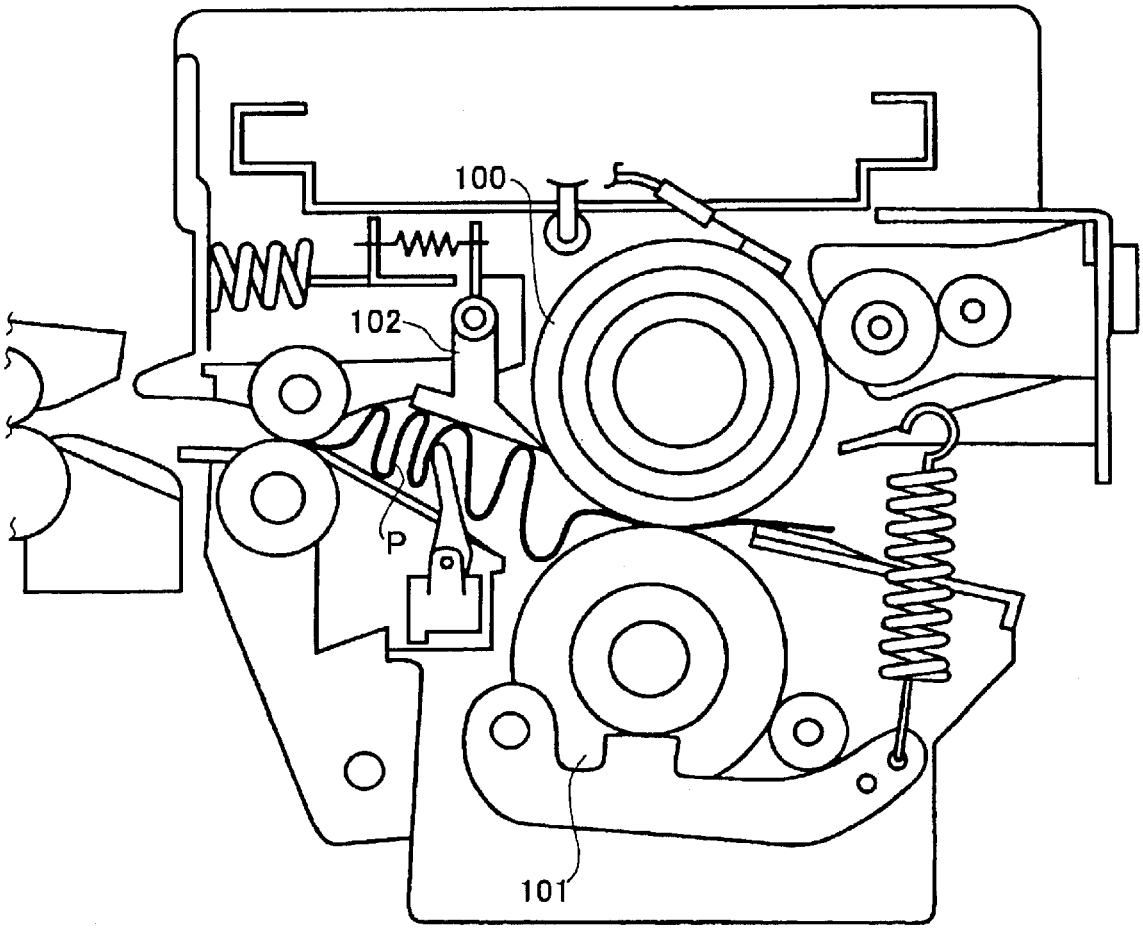
FIG.1 PRIOR ART
FIG. 1 shows a conventional fixing device.

To better understand the present invention, brief reference will be made to a conventional fixing device, shown in FIG. 1. As shown, the fixing device includes a heat roller 100 accommodating heating means therein and a press roller 101 pressed against the heat roller 100. The heat roller 100 and press roller 101 cooperate to fix a toner image carried on a sheet P with heat and pressure while nipping the sheet P therebetween. The sheet P is passed through the nip between the heat roller 100 and the press roller 101 with its image surface contacting the heat roller 100. To reduce toner offsets the surface of the heat roller 100 is coated with Teflon or covered with a Teflon tube that enhances parting ability.

A peeler 102 is held in contact with the heat roller 100 for preventing the sheet P from wrapping around the heat roller 100 due to, e.g., toner adhered to the heat roller 100. The peeler 102 is positioned slightly above the nip between the heat roller 100 and the press roller 101. In this condition, the underside of the peeler 102 serves to guide the sheet P between the heat roller 100 and an outlet roller pair.

The fixing device described above has the problem stated earlier More specifically, when the sheet P jams the path preceding the outlet roller pair, it deforms in the form of bellows and contacts the edge portion of the peeler 102, as illustrated. As a result, the sheet P presses the peeler 102 in the direction in which the peeler 102 bites into the heat roller 100. This causes the peeler 102 to peel off the Teflon layer of the heat roller 100 or otherwise damage it and makes it necessary to replace the heat roller 100. While the peeler may be configured to move in the direction in which it does not bite into the heat roller 100, such a scheme is not fully satisfactory, as also stated earlier.

Figure 2:
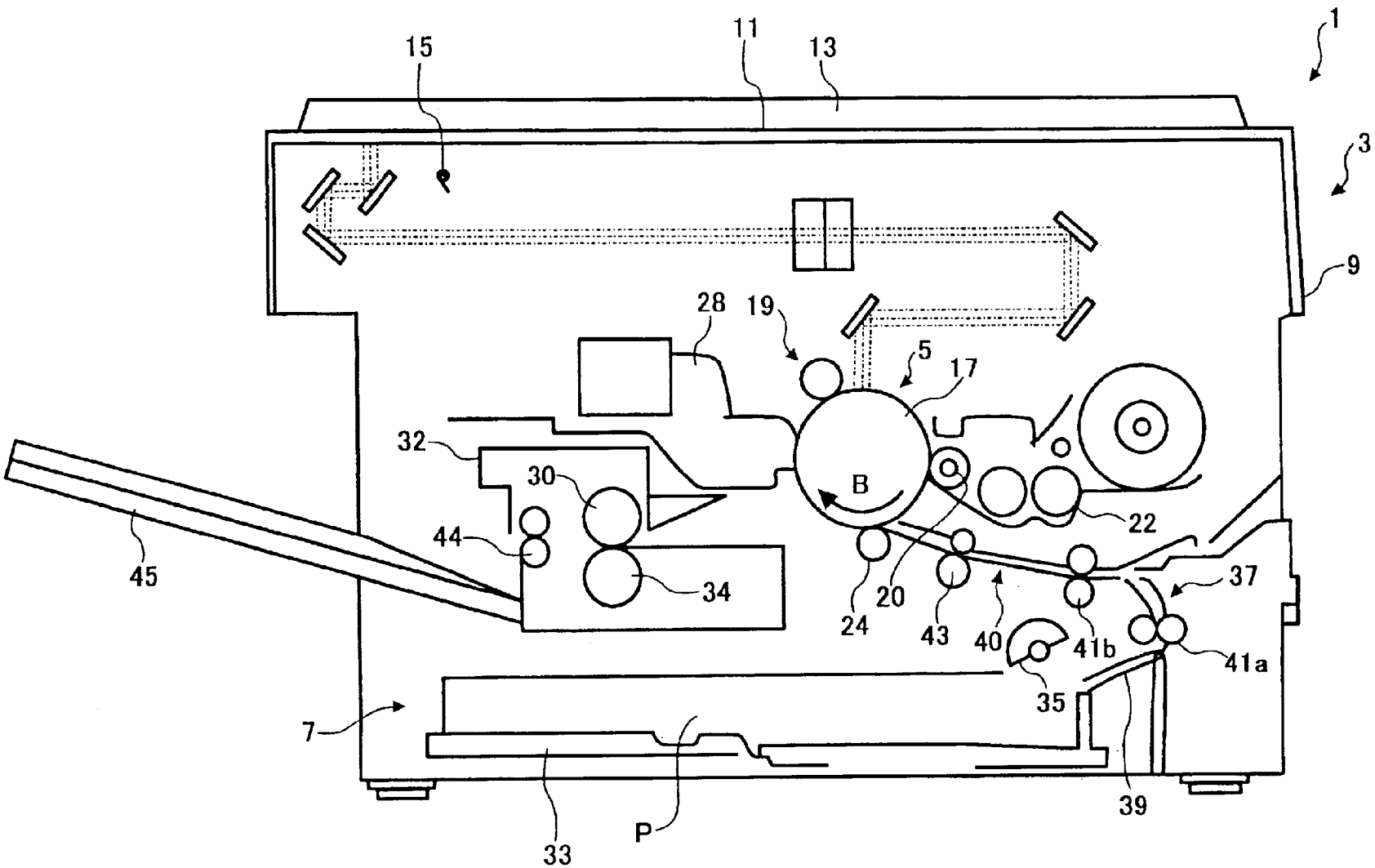
FIG. 2 shows an image forming apparatus including a fixing device embodying the present invention.

Referring to FIG. 2, an image forming apparatus using a fixing device embodying the present invention is shown and implemented as a copier by way of example. As shown, the copier is generally made up of a document scanning section 3, an image forming section 5 and a sheet feeding section 7, as named from the top to the bottom.

The document scanning section 3 includes a glass platen 11 mounted on the top of a cover 9 that surrounds the document scanning section 3. A cover plate 13 is openable away from the glass platen 11 and presses a document laid on the glass platen 11 when closed. Optics or exposing means 15 reads the document laid on the glass platen 11 so as to form a latent image on a photoconductive drum or image carrier 17.

The drum 17 is included in the image forming section 5 and rotatable clockwise, as indicated by an arrow B in FIG. 2. Arranged around the drum 17 are a charger or charging means 19, a developing device or developing means 22, an image transferring device or image transferring means 24, and a drum cleaner 28. The charger 19 uniformly charges the surface of the drum 17. The developing device 22 develops the latent image formed on the drum 17 with a sleeve 20 for thereby producing a corresponding toner image. The image transferring device 24 transfers the toner image from the drum 17 to a sheet P. The drum cleaner 28 removes toner left on the drum 17 after the image transfer.

A fixing device 32 is positioned below the drum cleaner 28 at the right-hand side of the drum cleaner 28, as viewed in FIG. 2. The fixing device 32 includes a heat roller or rotary body 30 and a press roller 34 pressed against the heat roller 30. The heat roller 30 and press roller 34 fix the toner image carried on the sheet P with heat and pressure. The sheet P driven out of the fixing device 32 is stacked on a tray 45.

The sheet feeding section 7 is arranged in the bottom portion of the copier 1 and includes a cassette 33 loaded with a stack of sheets P. A pickup roller 35 adjoins one end of the cassette 33 in the direction of sheet feed (right end in FIG. 2) and pays out the top sheet P from the cassette 33. A conveying device 37 conveys the sheet P thus paid out toward a nip between the drum 17 and the image transferring device 24.

The conveying device 37 includes a plurality of guide plates 39 that form a generally U-shaped path 40 extending from the right side of the pickup roller 35, as viewed in FIG. 2, to the nip between the drum 17 and the image transferring device 24. A first and a second roller pair 41*a* and 42*b* and a registration roller pair 43 are positioned on the path 40.

Figure 3:
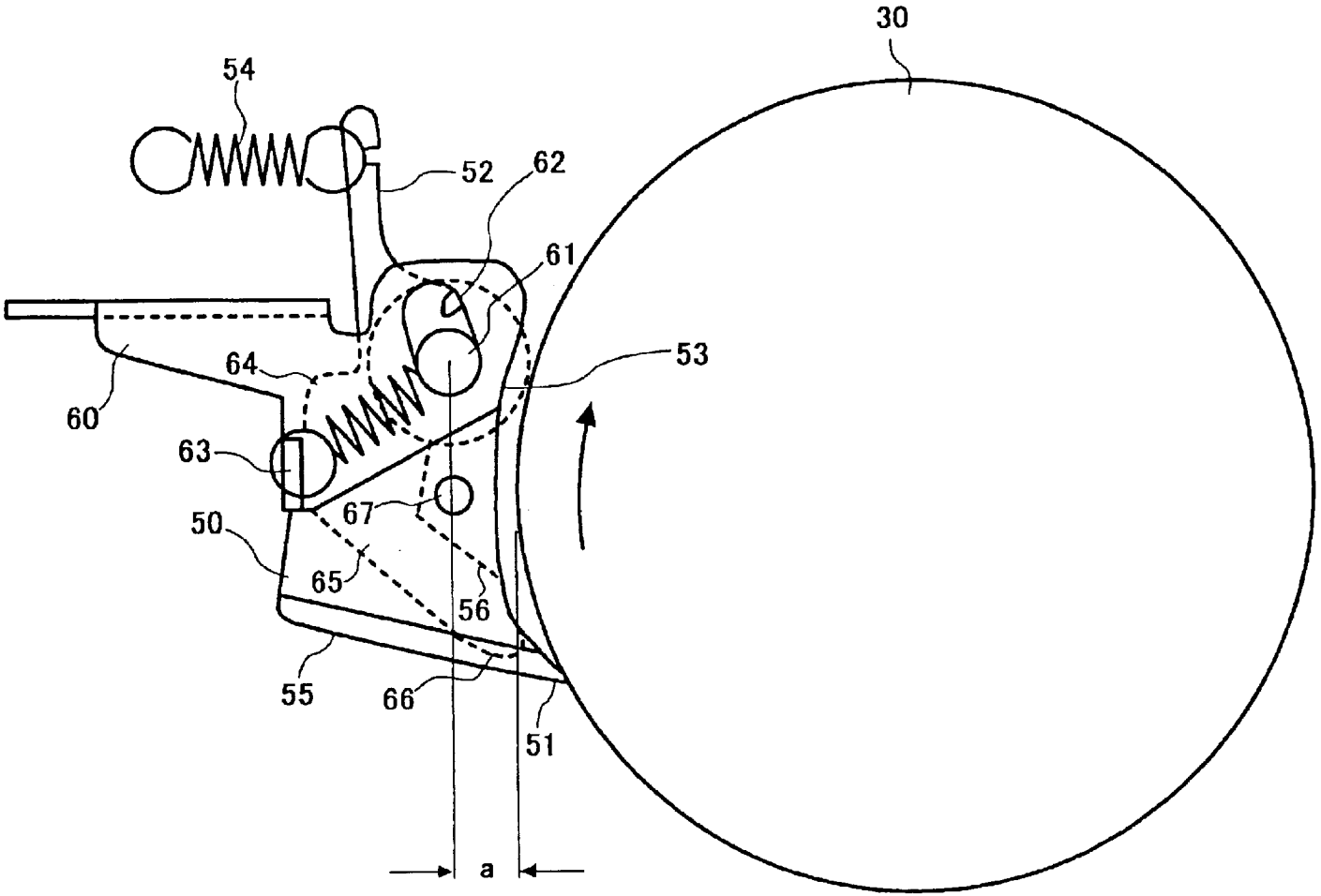
FIG. 3 shows a heat roller and a peeler included in the illustrative embodiment.
Figure 4:
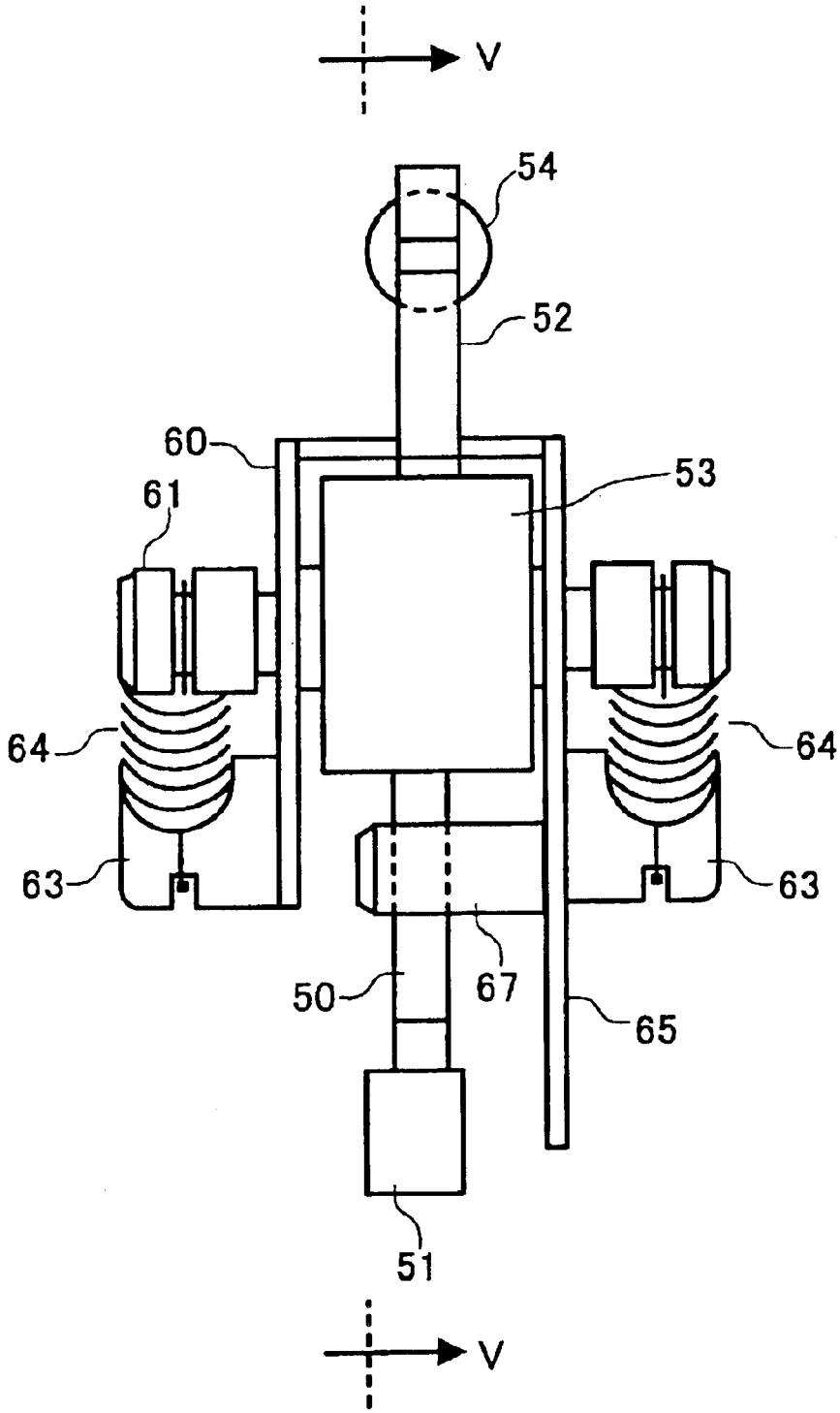
FIG. 4 is a side elevation showing the peeler as seen from the right of FIG. 3.
Figure 5:
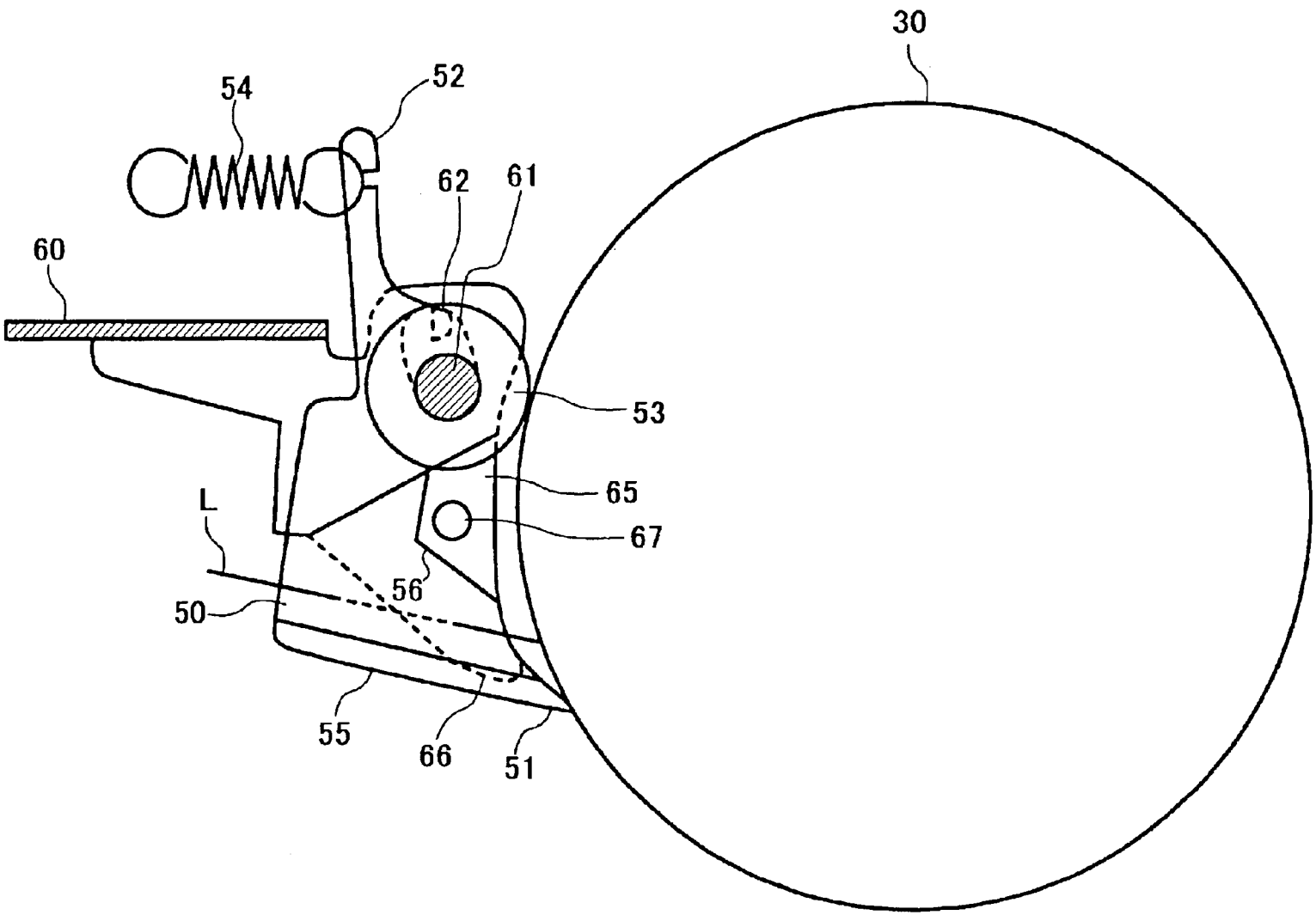
FIG. 5 is a sectional view along line V—V of FIG. 4.

FIG. 3 shows the heat roller 30 and a peeler 50 contacting the heat roller 30 in an enlarged view. FIG. 4 shows the peeler 50 in a side elevation as seen from the right of FIG. 3 while FIG. 5 shows it in a sectional view along line V—V of FIG. 4. As shown, the peeler 50 is generally made up of an edge portion 51 positioned at one end, a hook portion 52 positioned at the other end and extending upward, and a bearing portion 53 positioned at the center. A support shaft 61 is supported by a bracket 60 and passed through the bearing portion 53, so that the peeler 50 is rotatable about the support shaft 61. A spring or first biasing means 54 is anchored to a frame, not shown, at one end and anchored to the hook portion 52 of the peeler 50 at the other end. The spring 54 constantly biases the peeler 50 toward the heat roller 30.

The edge portion 51 of the peeler 50 includes a guide surface 55 configured such that when the leading edge of the sheet P contacts the guide surface 55, the guide surface 55 guides the sheet P toward an outlet roller pair 44 (FIG. 2). The guide surface 55 is implemented by the surface of the edge portion 51 opposite to the surface that faces the heat roller 30, i.e., the bottom as seen in FIG. 3. The support shaft 61 is passed through slots or guide means 62 formed in the bracket 60 and extending substantially in parallel to a line which is tangential to the heat roller 30 at a position where the peeler 50 contacts the heat roller 30.

Springs or second biasing means 64 each are loaded between the support shaft 61 and a retaining portion 63 included in the bracket 60, causing the support shaft 61 to rest on the lower ends of the slots 62. In this condition, the peeler 50 is held in contact with the heat roller 30 (contact position hereinafter). When the support shaft 61 abuts against the upper ends of the slots 62, the peeler 50 is spaced from the heat roller 30 (non-contact position hereinafter). In the non-contact position of the peeler 50, the guide surface 55 is raised to a position indicated by a phantom line in FIG. 5.

Assume that the sheet P jams the path and pushes the peeler 50 upward. Then, the support shaft 61 rises along the slots 62 against the action of the springs 64, moving the peeler 50 away from the heat roller 30. The peeler 50 is therefore prevented from scratching or otherwise damaging the heat roller 30. However, if the force of the sheet P urging the peeler 50 upward is strong and urges the peeler 50 further upward even after the support shaft 61 has reached the upper ends of the slots 62, then the edge portion 51 is likely to bite into the heat roller 30, depending on the direction of the above force.

In light of the above, the illustrative embodiment additionally includes a guide member 65 which the sheet P contacts when pushing the peeler 50 upward. While the guide member 65 is shown as forming part of the bracket 60, the former may be implemented as an independent member. The guide member 65 should preferably be positioned close to the peeler 50: otherwise, the sheet P might press only the peeler 50 without contacting the guide member 65, depending on the configuration of the sheet P. We experimentally found that as for a heat roller 30 with a diameter of 3 cm, the expected function of the guide member 65 was achievable when the distance between the guide member 65 and the peeler 50 was 5 mm or less.

The guide member 65 is formed with a guide surface 66 on its bottom. The guide surface 66 is substantially parallel to the guide surface 55 of the peeler 50 and so positioned as to contact the sheet P before the guide surface 55 rises to the position L. The guide surface 66 has a width a (FIG. 3) extending from a vertical line, which passes through the axis of the support shaft 61, to a position near the edge of the edge portion 51. The width a suffices because so long as the sheet P pushes the guide surface 55 of the edge portion 51 at the right-hand side of the width a, the force of the sheet P simply causes the peeler 50 to rotate about the support shaft 61 clockwise, as viewed in FIG. 3, releasing the edge portion 51 from the heat roller 30.

As stated above, when the sheet P jams the path and pushes the peeler 50 upward, it contacts the guide surface 66 of the guide member 65 and therefore stops pushing the peeler 50 further upward. It follows that even when the sheet P raises the peeler 50 more than expected, the peeler 50 is prevented from damaging the heat roller 30.

Further, a guide pin or stop means 67 is studded on the guide member 65 at a position close to the surface 56 of the edge portion 51 facing the heat roller 30 and which the peeler 50 contacts when pushed upward. When the sheet P pushes the peeler 50 upward, the surface 56 of the edge portion 51 contacts the guide pin 67 with the result that the peeler 50 is prevented from rotating counterclockwise, as viewed in FIG. 3, about the support shaft 61. More specifically, the surface 56 of the edge portion 51 is inclined upward to the left, as viewed in FIG. 3, when the surface 56 contacts the guide pin 67, so that the peeler 50 rotates clockwise along the above inclination. As a result, the edge portion 51 successfully moves away from the heat roller 30.

As stated above, when the sheet P pushes the peeler 50 upward, the guide pin 67 prevents the peeler 50 from rotating counterclockwise about the support shaft 61, i.e., in the direction in which the edge portion 51 bites into the heat roller 30. The heat roller 30 is therefore protected from damage ascribable to the peeler 50.

While the guide pin 67 may be studded on any desired member, it allows the guide member 65 and peeler 50 to be easily positioned relative to each other when studded on the guide member 65 as in the illustrative embodiment. Further, although the guide member 65 or the guide pin 67 suffices alone, both of them should preferably be used as a double safety measure.

While the rotary body is implemented as a heat roller 30 in the illustrative embodiment, it may alternatively be implemented as a press roller. Further, the illustrative embodiment is similarly applicable to a fixing device of the type including a flexible belt or film passed over a plurality of rollers, in which case the peeler 50 will be positioned adjacent any one of the rollers.

In summary, it will be seen that the present invention provides a fixing device and an image forming apparatus having various unprecedented advantages, as enumerated below.

(1) A guide member includes a guide surface that becomes substantially flush with the guide surface of a peeler when the peeler is moved from a contact position toward a non-contact position against the action of second biasing means. Therefore, even when the peeler is moved from the contact position toward the non-contact position by a recording medium, the sheet contacts the guide member, so that the peeler is prevented from biting into a rotary body.

(2) The guide surface of the guide member is positioned in a width over which the guide surface of the peeler moves between the contact position and the non-contact position, stopping the peeler before it bites into the rotary body.

(3) The guide surface of the guide member adjoins the peeler in the axial direction of the rotary body. This obviates an occurrence that the recording medium pushes the peeler, but does not contact the guide member.

(4) The above advantages are achievable even if the guide surface of the guide member extends only from a vertical line passing through the axis of a support shaft to a position near the edge of the peeler.

(5) Stop means limits the rotation of the peeler away from the rotary body against the action of first biasing means, implementing another measure against damage ascribable to the peeler.

(6) The stop means can be easily, accurately positioned relative to the peeler.

Various modifications will become possible for those skilled in the art after receiving the teachings of the present disclosure without departing from the scope thereof.

What is claimed is:

1. A fixing device comprising:

a rotary body;

a peeler rotatable about a support shaft and comprising an edge portion capable of contacting a surface of said rotary body, said edge portion including a guide surface opposite to a surface that faces said rotary body;

first biasing means for constantly exerting on said peeler a force that tends to cause said edge portion to contact said rotary body about said support shaft;

guide means for guiding said support shaft between a contact position where said edge portion contacts said rotary body and a non-contact position where said edge portion is released from said rotary body;

second biasing means for constantly biasing said support shaft toward the contact position; and a guide member including a guide surface that becomes substantially flush with said guide surface of said edge portion when said peeler is moved from the contact position toward the non-contact position against the action of said second biasing means.

2. The fixing device as claimed in claim 1, wherein said guide surface of said guide member has a width extending from a point where a vertical line crosses an axis of said support shaft to a position adjacent an edge of said edge portion.

3. The fixing device as claimed in claim 1, wherein said guide surface of said guide member adjoins said peeler in an axial direction of said rotary body.

4. The fixing device as claimed in claim 3, wherein said guide surface of said guide member has a width extending from a point where a vertical line crosses an axis of said support shaft to a position adjacent an edge of said edge portion.

5. The fixing device as claimed in claim 1, wherein said guide surface of said guide member lies in a width over which said guide surface of said peeler is movable between the contact position and the non-contact position.

6. The fixing device as claimed in claim 5, wherein said guide surface of said guide member adjoins said peeler in an axial direction of said rotary body.

7. The fixing device as claimed in claim 6, wherein said guide surface of said guide member has a width extending from a point where a vertical line crosses an axis of said support shaft to a position adjacent an edge of said edge portion.

8. A fixing device comprising:

a rotary body;

a peeler rotatable about a support shaft and comprising an edge portion capable of contacting a surface of said rotary body, said edge portion including a guide surface opposite to a surface that faces said rotary body;

first biasing means for constantly exerting on said peeler a force that tends to cause said edge portion to contact said rotary body about said support shaft;

guide means for guiding said support shaft between a contact position where said edge portion contacts said rotary body and a non-contact position where said edge portion is released from said rotary body;

second biasing means for constantly biasing said support shaft toward the contact position;

a guide member including a guide surface that becomes substantially flush with said guide surface of said edge portion when said peeler is moved from the contact position toward the non-contact position against the action of said second biasing means; and stop means for causing a surface of said edge portion facing said rotary body to contact said stop means, thereby causing said peeler to rotate about said support shaft away from said rotary body against an action of said first biasing means.

9. In an image forming apparatus comprising a fixing device, said fixing device comprising:

a rotary body;

a peeler rotatable about a support shaft and comprising an edge portion capable of contacting a surface of said rotary body, said edge portion including a guide surface opposite to a surface that faces said rotary body;

first biasing means for constantly exerting on said peeler a force that tends to cause said edge portion to contact said rotary body about said support shaft;

guide means for guiding said support shaft between a contact position where said edge portion contacts said rotary body and a non-contact position where said edge portion is released from said rotary body;

second biasing means for constantly biasing said support shaft toward the contact position; and a guide member including a guide surface that becomes substantially flush with said guide surface of said edge portion when said peeler is moved from the contact position toward the non-contact position against the action of said second biasing means.

10. The apparatus as claimed in claim 9, wherein said guide surface of said guide member lies in a width over which said guide surface of said peeler is movable between the contact position and the non-contact position.

11. The apparatus as claimed in claim 10, wherein said guide surface of said guide member adjoins said peeler in an axial direction of said rotary body.

12. The apparatus as claimed in claim 11, wherein said guide surface of said guide member has a width extending from a point where a vertical line crosses an axis of said support shaft to a position adjacent an edge of said edge portion.

13. In an image forming apparatus comprising a fixing device, said fixing device comprising:

a rotary body;

a peeler rotatable about a support shaft and comprising an edge portion capable of contacting a surface of said rotary body, said edge portion including a guide surface opposite to a surface that faces said rotary body;

first biasing means for constantly exerting on said peeler a force that tends to cause said edge portion to contact said rotary body about said support shaft;

guide means for guiding said support shaft between a contact position where said edge portion contacts said rotary body and a non-contact position where said edge portion is released from said rotary body;

second biasing means for constantly biasing said support shaft toward the contact position;

a guide member including a guide surface that becomes substantially flush with said guide surface of said edge portion when said peeler is moved from the contact position toward the non-contact position against the action of said second biasing means; and stop means for causing a surface of said edge portion facing said rotary body to contact said stop means, thereby causing said peeler to rotate about said support shaft away from said rotary body against an action of said first biasing means.

14. A fixing device comprising:

a rotary body;

a peeler rotatable about a support shaft and comprising an edge portion capable of contacting a surface of said rotary body, said edge portion including a guide surface opposite to a surface that faces said rotary body;

first biasing means for constantly exerting on said peeler a force that tends to cause said edge portion to contact said rotary body about said support shaft;

guide means for guiding said support shaft between a contact position where said edge portion contacts said rotary body and a non-contact position where said edge portion is released from said rotary body;

second biasing means for constantly biasing said support shaft toward the contact position; and stop means for causing, when said peeler is moved from said contact position toward said non-contact position against an action of said second biasing means, said peeler to rotate about said support shaft away from said rotary body against an action of said first biasing means.

15. The fixing device as claimed in claim 14, further comprising a guide member including a guide surface that becomes substantially flush with said guide surface of said edge portion when said peeler is moved from the contact position toward the non-contact position against an action of said second biasing means.

16. The fixing device as claimed in claim 15, wherein said stop means is mounted on said guide member.

17. The fixing device as claimed in claim 14, wherein said stop means comprises a guide pin which a surface of said peeler facing said rotary body contacts when said peeler is moved from the contact position toward the non-contact position against an action of said second biasing means.

18. The fixing device as claimed in claim 17, further comprising a guide member including a guide surface that becomes substantially flush with said guide surface of said edge portion when said peeler is moved from the contact position toward the non-contact position against an action of said second biasing means.

19. The fixing device as claimed in claim 18, wherein said stop means is mounted on said guide member.

20. In an image forming apparatus comprising a fixing device, said fixing device comprising:

a rotary body;

a peeler rotatable about a support shaft and comprising an edge portion capable of contacting a surface of said rotary body, said edge portion including a guide surface opposite to a surface that faces said rotary body;

first biasing means for constantly exerting on said peeler a force that tends to cause said edge portion to contact said rotary body about said support shaft;

guide means for guiding said support shaft between a contact position where said edge portion contacts said rotary body and a non-contact position where said edge portion is released from said rotary body;

second biasing means for constantly biasing said support shaft toward the contact position; and stop means for causing, when said peeler is moved from said contact position toward said non-contact position against an action of said second biasing means, said peeler to rotate about said support shaft away from said rotary body against an action of said first biasing means.

21. The apparatus as claimed in claim 20, further comprising a guide member including a guide surface that becomes substantially flush with said guide surface of said edge portion when said peeler is moved from the contact position toward the non-contact position against an action of said second biasing means.

22. The apparatus as claimed in claim 21, wherein said stop means is mounted on said guide member.

23. The apparatus as claimed in claim 20, wherein said stop means comprises a guide pin which a surface of said peeler facing said rotary body contacts when said peeler is moved from the contact position toward the non-contact position against an action of said second biasing means.

24. The apparatus as claimed in claim 23, further comprising a guide member including a guide surface that becomes substantially flush with said guide surface of said edge portion when said peeler is moved from the contact position toward the non-contact position against an action of said second biasing means.

25. The apparatus as claimed in claim 24, wherein said stop means is mounted on said guide member.

* * * * *